US005422069A

United States Patent [19]

Perfect

[11] Patent Number: 5,422,069

[45] Date of Patent: Jun. 6, 1995

[54] MASTER ALLOYS FOR BETA 21S TITANIUM-BASED ALLOYS AND METHOD OF MAKING SAME

[75] Inventor: Frederick H. Perfect, deceased, late of Wyomissing, Pa., by Marjorie L. Perfect executor

[73] Assignee: Reading Alloys, Inc., Robesonia, Pa.

[21] Appl. No.: 175,142

[22] Filed: Dec. 29, 1993

Related U.S. Application Data

[62] Division of Ser. No. 918,242, Jul. 23, 1992, Pat. No. 5,316,723.

[51] Int. Cl.[6] ..... B22F 3/16; B22F 9/30; C22C 1/05; C22C 21/00

[52] U.S. Cl. ..... 419/45; 419/46; 419/38; 419/57; 75/228; 75/249; 75/351; 75/959

[58] Field of Search ..... 419/38, 57, 45, 46; 75/228, 249, 351, 959

[56] References Cited

U.S. PATENT DOCUMENTS

| | | | |
|---|---|---|---|
| 4,104,059 | 8/1978 | Perfect | 75/134 F |
| 4,119,457 | 10/1978 | Perfect | 75/134 N |
| 4,331,475 | 5/1982 | Perfect | 420/428 |
| 4,695,321 | 9/1987 | Akashi et al. | 75/243 |
| 4,761,262 | 8/1988 | Ogata et al. | 419/10 |
| 4,820,483 | 4/1989 | Defrance | 419/23 |
| 4,909,842 | 3/1990 | Dunmead et al. | 75/236 |
| 4,946,643 | 8/1990 | Dunmead et al. | 419/12 |
| 5,139,720 | 8/1992 | Takeda et al. | 264/66 |
| 5,316,723 | 5/1994 | Perfect | 420/429 |

OTHER PUBLICATIONS

Waldron et al, "Sintering", Heydengsuns, 1978, pp. 16–17.

*Primary Examiner*—Donald P. Walsh
*Assistant Examiner*—Daniel Jenkins
*Attorney, Agent, or Firm*—Eckert Seamans Cherin & Mellott

[57] ABSTRACT

Master alloys and methods of producing same are disclosed, wherein an intermetallic compound, for example $Al_3Cb$ is first prepared via thermite processing, then size reduced, then mixed with other components in amounts yielding a mixture in the desired proportion for the master alloy. The mixture is compacted, then heated to produce the master alloy by fusion.

19 Claims, No Drawings

MASTER ALLOYS FOR BETA 21S TITANIUM-BASED ALLOYS AND METHOD OF MAKING SAME

This is a division of U.S. application Ser. No. 07/918,242, filed on Jul. 23, 1992, now U.S. Pat. No. 5,316,723.

FIELD OF THE INVENTION

The present invention relates to a master alloy, particularly for use in making beta Titanium-molybdenum alloys, and methods of making of such master alloys.

BACKGROUND OF THE INVENTION

Titanium-containing alloys find a broad range of applications in areas where low weight and strength are required, such as aerospace and military uses, as well as corrosion resistance and heat applications, including use in turbine blade jet engine parts, high speed cutting tools, and so on. Molybdenum is known to be difficult to diffuse uniformly in titanium, because of its higher melting point and higher density, which causes molybdenum-rich particles to drop to the bottom of a molten titanium pool where they sinter into agglomerates and form inclusions in the ingot produced. See, e.g., U.S. Pat. No. 3,508,910. The same problems of getting molybdenum to homogenize with titanium are also experienced with columbium, which like molybdenum, is also highly refractory.

Matters are further complicated in that titanium alloys require relatively tight chemistries, and often the chemistry of the desired master alloy is poorly compatible with the homogenous alloying of the various components, due to differences in component solubility, melting point, density, etc. Furthermore, the chemistry of the alloy is frequently dictated by the alloying process used.

Accordingly, it is an object of the invention to provide molybdenum/titanium alloys which may be readily formulated to be substantially free of high molybdenum inclusions.

Another object of the invention is to provide columbium/molybdenum/titanium alloys which may be readily formulated to be substantially free of columbium inclusions.

Still another object of the invention is to produce an alloy having relatively low aluminum.

SUMMARY OF THE INVENTION

In a preferred embodiment of the invention a thermite for use in preparing a Ti master alloy having low aluminum is produced, the master alloy comprising a predominant amount of Mo, and lesser amounts of Cb, Al, Si, $O_2$, C, $N_2$ and Ti. The master alloy of the invention comprises about 55–75% Mo, 6–16% Cb, 1–15 % Al, 0.1–5% Si, 0–1% $O_2$, 0–1% C, 0–1% $N_2$ and balance Ti. In a most preferred embodiment of the invention, the master alloy comprises about 55–65% Mo, 6–16% Cb, 5–15% Al, 0.1–5% Si, 0–1% $O_2$, 0–1% C, 0–1% $N_2$ and balance Ti.

DETAILED DESCRIPTION OF THE PREFERRED EMBODIMENTS

A master alloy is an alloy of selected elements that can be added to a charge of metal to provide a desired composition or texture or to deoxidize one or more components of the mixture.

According to the present invention, an intermetallic compound is first prepared using thermite processing. Thermite processing involves an exothermic reaction which occurs when finely divided aluminum mixed with metal oxides is ignited, causing reduction of the oxide and reaching temperatures of about 2200° C., sufficient to propagate heat through the charge to homogenize the components comprising the resulting intermetallic compounds.

Often, a simple thermite process uses a mixture of powdered iron (III) oxide, $Fe_2O_3$ and powdered or granular aluminum. However, oxides of metals other than iron may be used, as discussed herein, and mixtures of these oxides may likewise be used.

In practicing the invention, the mixed thermite components are charged to a furnace, typically a water-cooled, copper, below-ground reaction vessel, such as that described in "Metallothermic Reduction of Oxides in Water-Cooled Copper Furnaces," by F. H. Perfect, Transactions of the Metallurgical Society of AIME, Volume 239, August 1967, pp. 1282–1286. See also U.S. Pat. No. 4,104,059, incorporated by reference herein.

The mixture is thoroughly and intimately mixed prior to being charged to the furnace so the thermite reaction will occur rapidly and uniformly throughout the charge on ignition.

The reaction vessel is preferably covered after the mixture is charged and the pressure within the vessel may be reduced, for example, to about 0.3 mm Hg or less, followed by flooding the vessel with a high purity inert gas such as argon. Such evacuation and purging results in thermites of higher purity, lower nitrogen content. The thermite reaction is initiated with an igniter and allowed to proceed to completion.

After the thermite is prepared using thermite processing, it is cooled and size reduced to powdered form using known methods, such as crushers, ball mills, pug mills, grinders, hydriding, etc.

After size reduction, the intermetallic compound produced by the thermite process, typically $Al_3Cb$, is then mixed with at least one additional metal in powdered form, for example, Ti, to form a substantially uniform mixture. The resulting mixture is then pressed into a compact or briquetted with application of pressures of over about 7,000 psi and preferably of about 15,000–30,000 psi. Typically, such compacts are formed using an isostatic press.

It is preferable, especially when forming large compacts, to place spacers at intervals within the compact in order to insure uniform compaction and produce more manageable compact sizes. Ten pound discs of compact are typically produced. The discs are then stacked in the furnace, under vacuum or inert gas and when the reaction starts, it tends to be semi-continuous and controlled rather than violent. The smaller compacts, when stacked, also help prevent melting of the compact, which is in some cases an undesirable result.

The compacts or briquets are then heated, preferably with induction heat, to form the desired master alloy by fusion. No special pressure conditions are required for the fusion, which is generally carried out at atmospheric or a milli tor pressure and temperatures of about 600°–1,700° C., depending on the optimal fusion temperature of the compact.

In a preferred embodiment of the invention, a master alloy for use in preparing a Ti (Beta 21S) alloy having low aluminum (i.e., less than about 10% by weight aluminum) is prepared, comprising about 55–65% Mo, 6-16% Cb, 5-15% Al, 0.1-5% Si, 0-1% $O_2$, 0-1% C, 0-1% $N_2$ and balance Ti. In the thermite step the intermetallic compound $Al_3Cb$ is produced, by mixing powdered aluminum fines with $Cb_2O_5$ powder and at least one oxide, such as $Fe_2O_3$ or $SiO_2$. This thermite is then size reduced and mixed with powdered components, such as Mo and Ti, then compacted and fused. Most preferably, the master alloy so produced comprises about 60% Mo, 11% Cb, 10% or less Al, 0.4% or less Si, 0.25% or less $O_2$, 0.02% or less C, 0-0.03% or less $N_2$ and balance Ti. Unless otherwise specifically noted, all percentages set forth herein refer to weight percent.

It is preferred to use alcohol to keep the mix from separating prior to compaction. As previously discussed, the resulting alloy may be hydrided to produce an end product in size reduced form, as is known.

The master alloy is prepared as specified previously, then size reduced and mixed with sufficient Ti to yield a mixture, which upon compaction and melting yields an alloy comprising about 70-85% Ti, 10-20% Mo, 1-8% Al, 1-8% Cb, 0-1% Si, 0-1% $O_2$ and 0-1% Fe. (Beta 21S type alloy.)

EXAMPLES

Example 1

It was desired to produce a master alloy having the chemistry 10% Al, 11% Cb, 60% Mo, 0.02% C, 0.003% $N_2$, 0.11% $O_2$, 0.4% Si balance Ti. An intermetallic compound $Al_3Cb$ was produced using thermite processing as previously described. 5.5 pounds of this thermite, lot no. 42-096, comprising about 45.65% Al, 51.45% Cb, 2.32% Si, 0.015% C, 0.032% $O_2$, 0.004% S and 0.001% $N_2$ was prepared via thermite processing as previously described and crushed to $-50\times200$ mesh and mixed dry for five minutes with 15 pounds of $-100$ mesh Mo and 5.25 pounds of $-100\times325$ mesh Ti. After five minutes of dry mixing, 65 ml of alcohol was added and the mixture was remixed for 15 minutes. The mixture was then packed into a CIP bag and isostatically pressed at 25,000 psi to produce a 25.75 lb. compact 4.25" dia.$\times$10.75". The resulting compact was placed in a 200 lb. induction furnace graphite crucible and covered with a graphite lid, then purged with argon. The compact was heated to about 1600° C. for about 15 minutes. The argon flow was maintained while the fused compact cooled. The resulting master alloy was fully alloyed, was cleaned and crushed to $-20$ mesh, and analyzed as follows:

| RAI/McCreath | |
|---|---|
| Al | 10.10% |
| Cb | 11.064 |
| Mo | 60.08% |
| Ti | 17.94% |
| C | 0.057% |
| $N_2$ | 0.130% |
| $O_2$ | 0.263% |
| Si | 0.40% |
| S | 0.004% |

It is claimed:

1. A process for preparing a master alloy, which comprises:
   (a) providing a first mixture of at least one powdered metal and at least one powdered metal oxide, in which said at least one powdered metal and at least one powdered metal oxide are each independently selected from the group consisting of Al, Cb, Mo and Ti;
   (b) alloying said first mixture by a metallothermic reduction reaction to form an intermetallic alloy;
   (c) solidifying said intermetallic alloy by cooling;
   (d) size reducing said intermetallic alloy to form a powdered intermetallic alloy;
   (e) providing a second mixture of:said powdered intermetallic alloy and at least one other powdered metal, in which said at least one other powdered metal is selected from the group consisting of Cb, Mo and Ti;
   (f) pressing said second mixture to form a compacted second mixture;
   (g) alloying said compacted second mixture by a fusion reaction to form a master alloy which comprises Al-Cb-Mo-Ti; and,
   (h) solidifying said master alloy by cooling.

2. The process of claim 1, in which said first mixture of part (a) comprises said at least one powdered metal which comprises Al and said at least one metal oxide which comprises an oxide of Cb, and in which said intermetallic alloy of part (b) comprises an Al-Cb intermetallic alloy.

3. The process of claim 2, in which said second mixture of part (e) comprises said powdered intermetallic alloy of Al-Cb and said at least one other powdered metal of Mo and Ti.

4. The process of claim 1, in which said first mixture of part (a) further comprises at least one other powdered metal or at least one other metal oxide selected from the group consisting of Fe and Si.

5. The process of claim 1, in which said metallothermic reduction reaction of alloying part (b) further comprises:
   (i) charging a reaction vessel with said first mixture;
   (ii) evacuating said reaction vessel to a pressure of about 0.3 mm Hg or less;
   (iii) flooding said reaction vessel with an inert gas;
   (iv) igniting said first mixture to initiate the metallothermic reduction reaction to reduce said at least one powdered metal oxide with said at least one powdered metal reducing agent to form said intermetallic alloy; and,
   (v) cooling said intermetallic alloy.

6. The process of claim 5, in which said reaction vessel of part (b)(i) comprises a water-cooled, below-ground, copper vessel.

7. The process of claim 6, in which said inert gas of part (b)(ii) comprises argon.

8. The process of claim 1, in which said size reducing part (d) further comprises:
   (i) size reducing by crushing, milling, grinding or hydriding.

9. The process of claim 1, in which said pressing part (f) further comprises:
   (i) charging an isostatic press with said second mixture; and,
   (ii) isostatically pressing said second mixture with a pressure of over about 7,000 psi.

10. The process of claim 9, in which said pressure of said isostatically pressing part (f)(ii) is about 15,000 to 30,000 psi.

11. The process of claim 9, in which said charging part (f)(i) further comprises:
   (f)(i.1) charging said second mixture with spacers at intervals in said isostatic press to form a plurality of spaced apart compacts.

12. The process of claim 1, in which said fusion alloying part (g) further comprises:

(i) charging said compacted second mixture in a reaction vessel;

(ii) flooding said reaction vessel with inert gas; and, (iii) heating said compacted second mixture to the fusion temperature of said compact to form said master alloy; and, (iv) cooling said master alloy.

13. The process of claim 12, in which said reaction vessel of part (g)(i) comprises a graphite crucible and lid in an induction furnace.

14. The process of claim 12, in which said inert gas of part (g)(ii) comprises argon.

15. The process of claim 12, in which said compacted second mixture of part (g)(i) is charged in the reaction vessel by stacking said compacts in the reaction vessel.

16. The process of claim 1, in which the process further comprises:

(i) size reducing said master alloy to form a powdered master alloy;

(j) providing a third mixture of said powdered master alloy and at least one other powdered metal or metal oxide which comprises Ti; and, (k) alloying said third mixture to form a beta titanium alloy.

17. A master alloy produced according to the process of claim 1.

18. A master alloy produced according to the process of claim 2.

19. A master alloy produced according to the process of claim 3.

* * * * *